US008011145B1

(12) United States Patent
Collins et al.

(10) Patent No.: US 8,011,145 B1
(45) Date of Patent: Sep. 6, 2011

(54) SEGMENTED JOINT FOR MASONRY CONSTRUCTION

(75) Inventors: P. Michael Collins, Cincinnati, OH (US); Steven E. Schaefer, Cincinnati, OH (US)

(73) Assignee: PACC Systems I.P., LLC, Cincinnati, OH (US)

( * ) Notice: Subject to any disclaimer, the term of this patent is extended or adjusted under 35 U.S.C. 154(b) by 1120 days.

(21) Appl. No.: 11/754,633

(22) Filed: May 29, 2007

Related U.S. Application Data

(63) Continuation-in-part of application No. 10/842,886, filed on May 11, 2004, now abandoned, and a continuation-in-part of application No. 10/602,198, filed on Jun. 24, 2003, now abandoned, application No. 11/754,633, which is a continuation-in-part of application No. 10/989,790, filed on Nov. 16, 2004, now Pat. No. 7,526,897.

(60) Provisional application No. 60/803,241, filed on May 26, 2006, provisional application No. 60/391,333, filed on Jun. 25, 2002.

(51) Int. Cl.
*E06B 9/52* (2006.01)
*E06B 5/20* (2006.01)

(52) U.S. Cl. ..... 52/214; 52/204.53; 52/396.05; 52/393; 52/396.1; 52/98; 52/513

(58) Field of Classification Search ..... 52/506.05, 52/508, 513, 511, 715, 302.1, 302.3, 209, 52/98, 100, 213, 99, 204.61, 214, 204.53, 52/393, 396.05, 395, 396.1
See application file for complete search history.

(56) References Cited

U.S. PATENT DOCUMENTS

| | | | | | |
|---|---|---|---|---|---|
| 779,268 | A | * | 1/1905 | Elliott | 52/428 |
| 1,280,173 | A | * | 10/1918 | Cutler | 52/712 |
| 1,361,586 | A | | 12/1920 | Johnson | |
| 1,725,200 | A | * | 8/1929 | Lampert | 52/379 |
| 1,832,231 | A | * | 11/1931 | Menninger | 52/378 |
| 1,936,223 | A | * | 11/1933 | Awbrey | 52/562 |
| 2,011,510 | A | * | 8/1935 | Ackenbrack | 52/385 |
| 2,056,024 | A | | 9/1936 | Stuart | |
| 2,115,137 | A | * | 4/1938 | Bosco | 52/699 |
| 2,305,413 | A | | 12/1942 | Gelin | |

(Continued)

FOREIGN PATENT DOCUMENTS

DE 3410131 3/1985

(Continued)

*Primary Examiner* — Phi Dieu Tran A
(74) *Attorney, Agent, or Firm* — Wood, Herron & Evans, LLP

(57) ABSTRACT

A joint device is installed between adjacent components during construction to provide a proper transition between the components. The joint device has a generally L-shaped configuration with a first leg of the device that may be mounted to the outer face of the inner wall of a cavity wall construction and in the cavity between the spaced walls. The second leg projects generally perpendicularly from the first leg and from the inner wall toward the outer wall adjacent the bricks at which the movement joint is located. The second leg of the joint includes a series of segments in which a terminal end portion of the second leg is joined to a remainder thereof by frangible connections or perforated joints. After the joint device is installed on the inner wall and the outer wall is constructed, the terminal end portion of the second leg is removed by being torn along the appropriate frangible joint depending upon the spacing between the components.

13 Claims, 3 Drawing Sheets

U.S. PATENT DOCUMENTS

| | | | | | |
|---|---|---|---|---|---|
| 2,432,445 | A | * | 12/1947 | Roe | 52/309.1 |
| 1,629,143 | A | | 2/1953 | Spector et al. | |
| 2,859,493 | A | | 11/1958 | Matschke | |
| 2,979,788 | A | | 4/1961 | Richardson | |
| 3,155,204 | A | | 11/1964 | Campbell et al. | |
| 3,156,022 | A | | 11/1965 | Schlegel | |
| 3,293,810 | A | * | 12/1966 | Cox et al. | 52/302.6 |
| 3,295,287 | A | * | 1/1967 | Pasquale | 52/714 |
| 3,309,832 | A | | 3/1967 | Filsinger | |
| 3,319,384 | A | * | 5/1967 | Berg | 52/100 |
| 3,330,187 | A | * | 7/1967 | Kohler et al. | 404/65 |
| 3,411,977 | A | * | 11/1968 | Slater, Jr. | 428/33 |
| 3,512,318 | A | * | 5/1970 | Turner | 52/100 |
| 3,559,358 | A | * | 2/1971 | Lohse et al. | 52/379 |
| 3,707,815 | A | | 1/1973 | Molyneux | |
| 3,759,005 | A | | 9/1973 | Smith | |
| 3,807,107 | A | * | 4/1974 | Davis | 52/99 |
| 3,837,041 | A | | 9/1974 | Modert et al. | |
| 3,846,948 | A | | 11/1974 | Dallen | |
| 3,919,815 | A | | 11/1975 | Alabaster | |
| 3,922,826 | A | | 12/1975 | Molyneux | |
| 3,958,383 | A | | 5/1976 | Dallen | |
| 4,000,595 | A | * | 1/1977 | Fortescue | 52/302.3 |
| 4,058,947 | A | | 11/1977 | Earle et al. | |
| 4,084,361 | A | | 4/1978 | Aspaas | |
| 4,092,812 | A | | 6/1978 | Dashner | |
| 4,189,877 | A | | 2/1980 | Jentoft et al. | |
| 4,265,052 | A | | 5/1981 | Johnson | |
| 4,272,931 | A | | 6/1981 | Stanizzo | |
| 4,302,916 | A | | 12/1981 | Molyneux | |
| 4,335,550 | A | | 6/1982 | Johnson | |
| 4,349,994 | A | | 9/1982 | Maekawa | |
| 4,505,079 | A | | 3/1985 | Black | |
| 4,519,866 | A | | 5/1985 | Stol | |
| 4,601,144 | A | | 7/1986 | Tinti | |
| 4,606,163 | A | * | 8/1986 | Catani | 52/434 |
| 4,621,956 | A | | 11/1986 | Hartman et al. | |
| 4,622,796 | A | * | 11/1986 | Aziz et al. | 52/747.12 |
| 4,811,537 | A | * | 3/1989 | D'Epenoux | 52/385 |
| 4,837,991 | A | | 6/1989 | Shaw | |
| 4,852,320 | A | * | 8/1989 | Ballantyne | 52/302.3 |
| 4,916,790 | A | | 4/1990 | Vlahogeorge | |
| 4,967,519 | A | | 11/1990 | Sieber | |
| 4,972,640 | A | * | 11/1990 | DiFazio | 52/204.53 |
| 4,982,530 | A | | 1/1991 | Palmer | |
| 5,035,099 | A | * | 7/1991 | Lapish | 52/713 |
| 5,058,254 | A | | 10/1991 | Vlahogeorge | |
| 5,058,323 | A | | 10/1991 | Gerritsen | |
| 5,073,430 | A | * | 12/1991 | Aidan | 428/43 |
| 5,115,605 | A | | 5/1992 | Butler | |
| 5,119,605 | A | | 6/1992 | Sieber | |
| 5,127,204 | A | | 7/1992 | Braun | |
| 5,181,357 | A | | 1/1993 | Pourtau et al. | |
| 5,211,506 | A | | 5/1993 | Manion | |
| 5,347,781 | A | * | 9/1994 | Hanlon | 52/379 |
| 5,440,847 | A | | 8/1995 | Butler | |
| 5,473,851 | A | * | 12/1995 | Northrup, Jr. | 52/513 |
| 5,596,851 | A | | 1/1997 | Ting | |
| 5,671,571 | A | * | 9/1997 | Braun | 52/211 |
| 5,671,578 | A | * | 9/1997 | Hohmann | 52/562 |
| 5,722,746 | A | | 3/1998 | Hull et al. | |
| 5,769,562 | A | * | 6/1998 | Jones | 404/7 |
| 5,815,986 | A | | 10/1998 | Laska | |
| 5,816,008 | A | * | 10/1998 | Hohmann | 52/565 |
| 5,845,443 | A | * | 12/1998 | Wirkus et al. | 52/308 |
| 5,918,427 | A | * | 7/1999 | VanderWerf | 52/100 |
| 5,924,253 | A | | 7/1999 | Walker | |
| 6,122,883 | A | | 9/2000 | Braun | |
| 6,148,576 | A | * | 11/2000 | Janopaul, Jr. | 52/426 |
| 6,205,724 | B1 | * | 3/2001 | Garling et al. | 52/209 |
| 6,212,841 | B1 | * | 4/2001 | Plume | 52/513 |
| 6,244,001 | B1 | | 6/2001 | Anastasi | |
| 6,269,591 | B1 | * | 8/2001 | Kelly | 49/482.1 |
| 6,269,597 | B1 | | 8/2001 | Haas | |
| 6,385,925 | B1 | * | 5/2002 | Wark | 52/209 |
| 6,418,688 | B1 | | 7/2002 | Jones, Jr. | |
| 6,516,573 | B1 | | 2/2003 | Farrell et al. | |
| 6,993,874 | B2 | * | 2/2006 | Trout | 52/393 |
| 7,017,318 | B1 | * | 3/2006 | Hohmann et al. | 52/562 |
| 7,325,366 | B1 | * | 2/2008 | Hohmann et al. | 52/513 |

FOREIGN PATENT DOCUMENTS

| | | | |
|---|---|---|---|
| EP | 357260 | A1 * | 3/1990 |
| EP | 358262 | A1 * | 3/1990 |
| EP | 501642 | | 9/1992 |
| FR | 2620761 | | 9/1988 |
| JP | 5-141078 | | 6/1993 |

* cited by examiner

SEGMENTED JOINT FOR MASONRY CONSTRUCTION

This claims the benefit of U.S. Provisional Patent Application Ser. No. 60/803,241, filed May 26, 2006 and is a continuation in part of U.S. patent application Ser. No. 10/842,886, filed May 11, 2004, and a continuation in part of U.S. patent application Ser. No. 10/602,198, filed Jun. 24, 2003 which claimed the benefit of U.S. Provisional Application Ser. No. 60/391,333, filed Jun. 25, 2002 and a continuation-in-part of U.S. patent application Ser. No. 10/989,790, filed Nov. 16, 2004. Each of these earlier applications is hereby incorporated by reference in its entirety.

BACKGROUND OF THE INVENTION

This invention relates to joints used in masonry construction and, more particularly, to a segmented movement joint used in a veneer/cavity wall system as well as other applications.

Wall systems having a masonry exterior are typically constructed of at least one vertical layer of masonry components and at least a second vertical layer of a material forming a back-up system. The back-up system may be constructed of lumber, light gauge steel studs or of a concrete masonry unit. The masonry and back-up systems are typically bonded together by horizontal metallic ties spaced apart vertically. A space is often provided in such wall systems (e.g., cavity wall systems) between the masonry and back-up systems for moisture drainage. The masonry wall or veneer includes numerous bricks or other masonry components arranged in various configurations to form the wall. Mortar is used between the masonry units and excess mortar is often difficult to control curing the construction of the masonry wall.

Because all materials in a building experience changes in volume, a system of movement joints is necessary to allow these movements to occur. The type, size and placement of movement joints is critical to the proper performance of the building. There are various types of movement joints in buildings including expansion joints, control joints, building expansion joints, and construction joints. Each type of movement joint is designed to perform a specific task.

An expansion joint is used to separate brick masonry into segments to prevent cracking due to changes in temperature, moisture expansion, elastic deformation due to loads, and creep. Expansion joints may be horizontal or vertical. The joints are formed of highly elastic materials placed in a continuous, unobstructed opening through the brick wythe. This allows the joints to close as a result of an increase in size of the brickwork. Expansion joints must be located so that the structural integrity of the brick masonry is not compromised.

A control joint is used in concrete or concrete masonry to create a plane of weakness which, used in conjunction with reinforcement or joint reinforcement, controls the location of cracks due to volume changes resulting from shrinkage and creep. A control joint is usually a vertical opening through the concrete masonry wythe. A control joint will open rather than close. Control joints must be located so that the structural integrity of the concrete masonry is not affected.

A building expansion (isolation) joint is used to separate a building into discrete sections so that stresses developed in one section will not affect the integrity of the entire structure. The isolation joint is a through-the-building joint. A construction joint (cold joint) is used primarily in concrete construction where construction work is interrupted. Construction joints are located where they will least impair the strength of the structure.

Although the primary purpose of expansion joints is to accommodate movement, the joint must also resist water penetration and air infiltration. Fiberboard and other similar materials are not suitable for this purpose because they are not highly compressible and, after being compressed, they will not expand to their original size. When placing expansion joints in brick, materials such as mortar or joint reinforcement should not bridge the expansion joint. If this occurs, movement will be restricted and the expansion joint will not perform as intended. Expansion joints should be formed as the wall is built. Sealants are used on the exterior side of the expansion joint to act as a seal against water and air penetration.

These are a few examples of movement joints utilized in the construction industry and this invention is not limited to any particular type of joint described herein or not described herein. Currently, many movement joints utilize a backer rod, which is a circular foam rod, behind the sealant to keep the sealant at a constant depth and provide a surface to tool the sealant against. The depth of the sealant should be consistent and generally one-half the width of the expansion joint, with a minimum sealant depth of ¼ in. (6 mm).

Problems often arise during the construction of a building or other structure, be it a cavity wall or other building system, in maintaining a proper spacing between adjacent building or construction components, such as the outer, masonry veneer and the inner wall. Commercial buildings have numerous lengthy joints between various components or surfaces. The joints must be sealed with caulking compound or other suitable material placed adjacent the surfaces of the components. Backer rods, typically produced from polyethylene, are initially installed in the joint at a specified depth with the remaining portion of the joint from the backer-rod to the outside surface then being filled with caulking compound.

The typical practice in installing a backer-rod is to initially force the backer-rod into the joint and to then further force the backer-rod to the predetermined depth by means of forcing a putty knife against the rod. Use of such a tool does not provide accurate depth control of the backer-rod since the putty knife does not provide any means for measuring the depth of the slot or joint once the rod is installed. Further, many commercial buildings have thousands and thousands of linear feet of joints requiring an inordinate amount of time for the installation of the backer-rod to the predetermined depth. If the joint is not properly constructed, the caulk may fail or separate from the adjacent components thereby jeopardizing the fluid impermeable joint when the components expand or contract in response to changes in the weather.

Municipal building codes differ from locale to locale and different construction techniques make predictable spacing for caulk application nearly impossible. Particularly, the spacing between the inner and outer walls is often different from building to building and even from location to location within the same building. As a result, the detailing and finishing work required for proper transition between building or construction components such as movement joints in a masonry veneer or cavity wall construction is typically very labor intensive, non-uniform and highly dependent upon the skill and experience of the particular contractor or tradesman performing the installation. Because of the importance and wide spread popularity of concrete and masonry structures, a better method for proper and consistent installation of movement joints between adjacent building components is needed.

SUMMARY OF THE INVENTION

This invention provides a solution to these and other problems in the art and allows an efficient and reliable installation for an aesthetically pleasing transition between adjacent building or construction components, including, but not limited to, movement joints in cavity wall applications having a masonry veneer. Generally, this invention includes a joint device for placement between adjacent bricks or other building and construction components for subsequent caulking.

In one embodiment, this invention includes a joint device installed between adjacent bricks prior to or during construction of the masonry veneer to provide a proper transition from the inner frame wall to the outer wall structure as well as a movement joint in the masonry veneer. In one embodiment, the joint device has a generally L-shaped configuration with a first leg of the device being mounted to the outer face of the inner wall of the cavity wall construction and in the cavity between the spaced walls. The second leg of the device projects generally perpendicularly from the first leg and from the inner wall toward the outer wall adjacent the bricks at which the movement joint is located. Additionally, in one embodiment, the second leg of the joint device includes a closed cell foam material having a series of segments in which a terminal end portion of the second leg is joined to a remainder thereof by one or more frangible connections or perforated segments. Advantageously, the frangible connections or segments in the joint device may be non-linear or arcuate-shaped to provide a crown-shaped or convex-shaped surface to receive the caulking compound to finish the movement joint.

After the joint device is installed adjacent the inner wall and the outer wall is subsequently constructed, the terminal end portion(s) of the second leg is/are removed by being torn along the appropriate frangible joint depending upon the spacing between the inner and outer walls at the movement joint location. After the terminal end portion is removed, a recess is exposed at a juncture of the bricks or other building components. A bead of caulk or similar finishing material is applied in the recess to provide a smooth and aesthetically pleasing transition across the movement joint. Additionally, the juncture across the movement joint at the outer wall is sealed by the caulk bead to inhibit and/or prevent the entry of moisture or other foreign material. Additional embodiments of the invention are also contemplated for these and other construction applications.

The convex or crown shape of the exposed surface of the joint device material allows for and promotes integrity of the caulking compound during shifting, expansion and/or contraction of the adjacent building components relative to each other. Advantageously, the joint device material is readily adaptable for use with a wide variety of building and construction applications, including movement joints of all kinds, window and door frame designs and construction specifications without requiring highly skilled or specialized installation and construction techniques.

Other embodiments of this invention are also disclosed for use in other environments and applications in the construction industry.

BRIEF DESCRIPTION OF THE DRAWINGS

The objectives and features of the invention will become more readily apparent from the following detailed description taken in conjunction with the accompanying drawings in which.

DETAILED DESCRIPTION OF THE INVENTION

Figure 1:
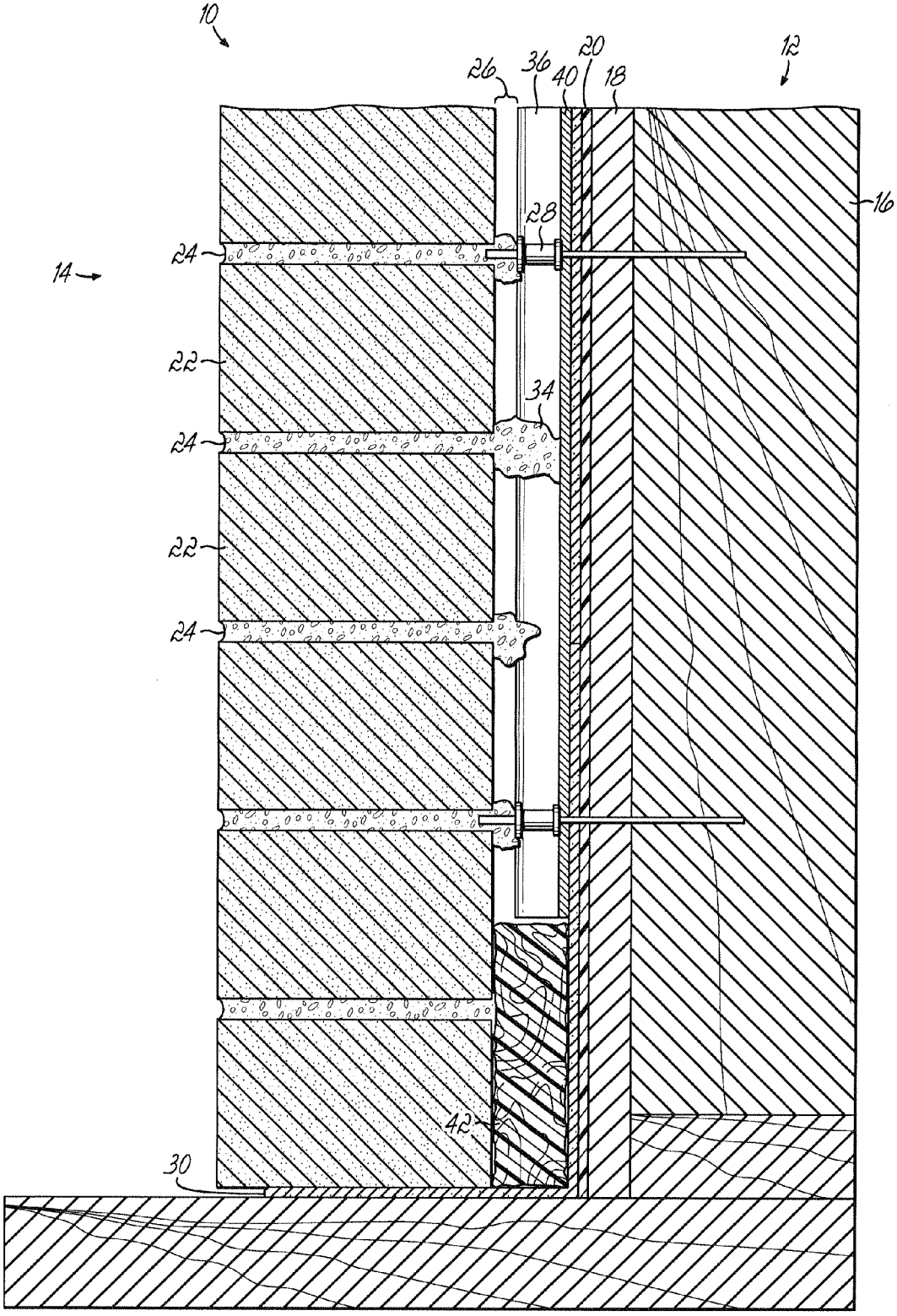
FIG. 1 is an exemplary cross-sectional view of a masonry cavity wall.

Referring to FIG. 1, an exemplary cavity wall installation 10 is shown. The cavity wall 10 is made with inner and outer walls 12, 14. The inner wall 12 is typically constructed from wood or steel studs 16 with an interior surface of drywall (not shown) or the like. The outer face of the inner wall 12 typically includes a layer of sheathing 18 such as plywood, particle board or the like, that is nailed to the wood framed wall 12. Commonly, an air barrier 20 covers the sheathing material 18 to limit moisture from progressing through the inner wall 12. The outer wall 14 is generally constructed of masonry materials 22, such as bricks, stone or the like, that are held together by mortar 24. Common practice in many municipal building codes requires a space of at least one inch forming a cavity 26 between the inner and outer walls 12, 14. The reason for this cavity 26 is to provide a space for water to drain and air to circulate, thereby keeping the cavity 26 dry. Anchors 28 span the cavity 26 and are embedded into the mortar 24 securing the outer wall 14 to the inner wall 12. Flashing 30 of PVC, asphalt impregnated membrane or other materials is included on the lower portion of the inner wall 12 and across the bottom of the cavity 26 covering a portion of a foundation 32 to underlay the outer wall 14. At that location in the masonry wall 14, the head joints are periodically left open to form a weep area that allows for moisture drainage and an air inlet.

Frequently during the construction of a building with a brick veneer/cavity wall 10, the mortar 24 and other debris can and does escape from the back face of the outer wall 14 to contact the air barrier 20 on the inner wall 12 or other areas of the construction site. Excess mortar that spans the cavity between the two walls is referred to as "bridging" 34. Excess mortar may block drainage paths or otherwise foul the components of the wall 10.

A corrugated panel or board 36 may be secured to the inner wall 12 to establish a defined spacing between the inner and outer walls 12, 14 and prevent excess mortar 34 from bridging to the inner wall 12. One such board 36 is disclosed in the inventor's prior patent application published as U.S. Publication No. US 2004/0003558A1, which is hereby incorporated by reference in its entirety. The corrugated board 36 has a series of spaced channels, furrows or grooves 38 into which the anchor 28 projects into the studs 16 of the inner wall 12 to secure the outer wall 14. The corrugated board 36 is installed prior to the construction of the outer wall 14 and establishes a minimum spacing or gap between the walls 12, 14 based upon the thickness of the board 36.

The grooves or channels 38 of the corrugated board 36 create a chamber for vapor and air circulation thereby minimizing the conditions that promote mold growth in the cavity 26 between the two walls 12, 14. A self-sealing tape 40 may be applied to the interface between the inner wall 12 and the anchor channels 38 so that when the anchors 28 penetrate the corrugated board 36, the self-sealing tape 40 seals around the anchor 28 to maintain the moisture barrier and minimize the chance of leaking at this location. Preferably, the bottom edge of the board 36 is spaced about three inches or more from the foundation 32 to allow for inlet and outlet venting of air.

Excess mortar that falls in the cavity to the foundation at the base of the two walls 12, 14 often plugs the weep area that could also result in another condition that is similar to bridging and provide another mold growth environment. A mortar collector 42 such as a net or similar device is commonly provided atop the foundation 32 at the base between the two walls 12, 14 to inhibit clogging the weep holes.

The brick veneer outer wall 14 is constructed from bricks or blocks 22 arranged in a vertical pattern. The brick veneer 14 is built up by placing one layer of bricks 22 over another layer. The spaces between adjacent bricks 22 and between adjacent layers of bricks are filled with mortar 24. Alternatively, the veneer 14 may be stone or other masonry components.

Figure 2:
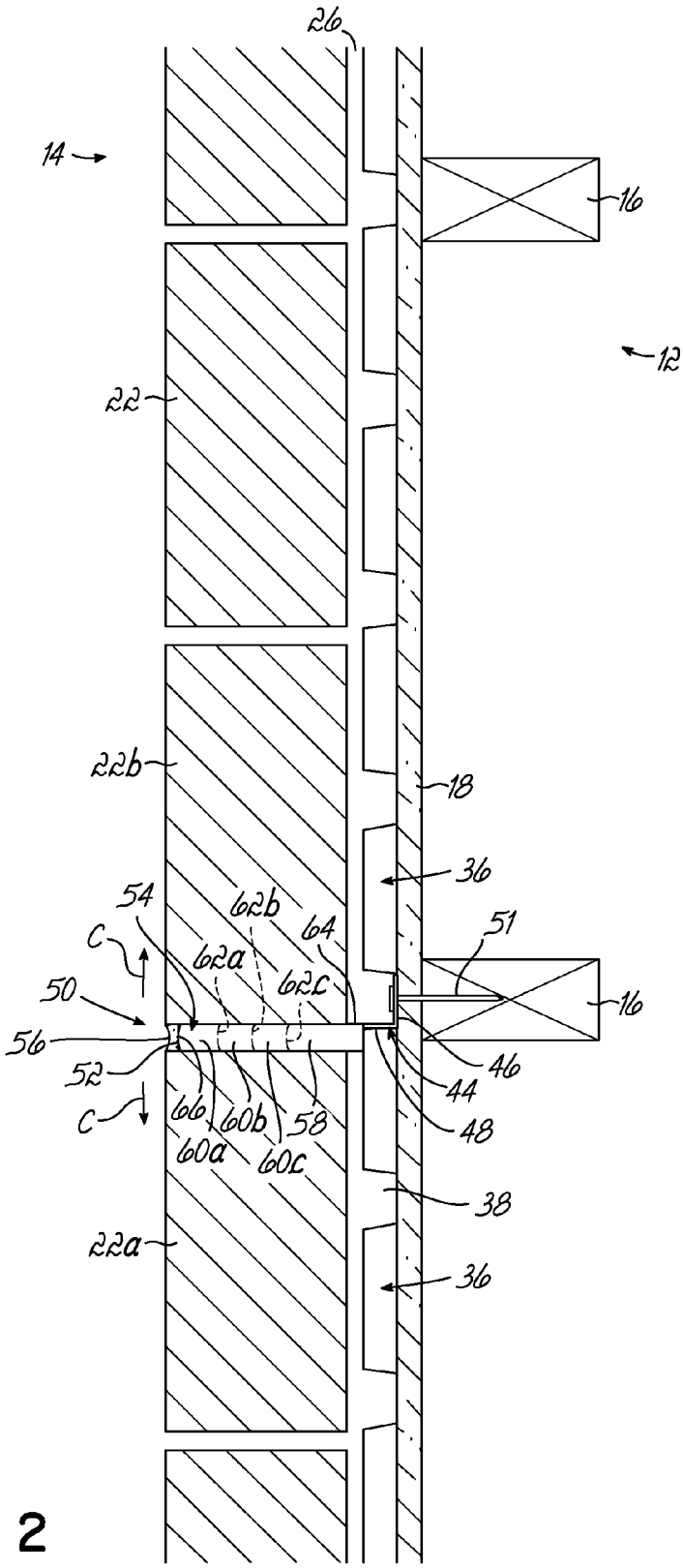
FIG. 2 is an enlarged cross-sectional view of the wall of FIG. 1 showing a segmented movement joint device according to one embodiment of this invention.

Referring to FIG. 2, one embodiment of a joint device 44 is shown installed in the walls 12, 14. In one embodiment, the joint device 44 is generally L-shaped, in which a first leg 46 of the device 44 confronts an outer face of the inner wall 12, and a second leg 48 of the device 44 projects generally perpendicular to the plane of the wall 12 and is juxtaposed between adjacent bricks 22*a*, 22*b* and keeps space clear during construction of the outer wall 14 at a movement joint 50. In one embodiment, the joint device 44 is installed prior to the construction of the outer wall 14 to prevent excess mortar from blocking the joint 50 area. The first leg 46 may be mounted to the inner wall 12 by a nail 51 or other fastener projecting into the stud 16 and is in place prior to construction of the outer wall 14. In other embodiments of this invention, the first leg 46 may be omitted and the joint device 44 utilizes leg 48 between the building components 22*a*, 22*b*. As is readily apparent, particularly from FIG. 2, the forward-most edge 52 of the leg 48 is recessed relative to the front face of the outer wall 14.

A recess 54 is formed between the adjacent components 22*a*, 22*b*. The material of the second leg 48 is open or closed cell foam or similar material and is inserted in the recess 54 and a bead of caulk 56 is applied between the adjacent bricks 22*a*, 22*b* of wall 14 to provide a proper finished transition, and thereby substantially cover and seal the movement joint 50.

The joint 50 of this invention also allows for expansion and contraction of one component because mortar is stopped from bridging into the space occupied by the joint device 44, such as the brick 22*a* relative to another component, such as the brick 22*b* during a variety of climatic conditions.

Referring to FIG. 2, the second leg 48 according to one embodiment of this invention is segmented and includes a main body portion 58 and one or more distal, terminal end portions 60*a*, 60*b*, 60*c* serially connected to the body portion 58 by frangible joints or connections 62*a*, 62*b*, 62*c*. Advantageously, each frangible joint or connection 62*a*, 62*b*, 62*c* may be shaped arcuately or non-linearly relative to the planar, spaced, side edges 64 of the second leg 48.

As a result of the arcuate-shaped frangible connections 62 between the body portion 58 and the adjacent end portions 60 of the second leg 48, when the joint device 44 is inserted into the joint 50 between adjacent building components, such as the bricks 22*a*, 22*b* of the wall 12, one or more of the terminal end portions 60 is severed or removed from the body portion 58 along the appropriate arcuate-shaped frangible connection 62. As a result, the joint device 44 remaining in the joint 50 includes a crown or convex-shaped surface or edge 66. Depending upon the geometry of the joint 50, the second leg 48 may include any number of serially connected terminal end portions 60 and the appropriate frangible connections 62 as shown in FIG. 2. The appropriate number of the terminal end portions 60 are removed to present the recessed convex or crown-shaped surface 66 as shown in FIG. 2.

After the terminal end portion(s) 60 is/are removed from the body portion 58 of the leg 48, the appropriate bead of caulk 56 is applied to the crown or convex-shaped surface 66 of the joint device 44 to provide a finished transition between the adjacent building or construction components 22*a*, 22*b*. Advantageously, the crown or convex-shaped surface 66 accommodates expansion, contraction and/or general movement of the adjacent building components 22*a*, 22*b* as shown by arrows C in FIG. 2 without separation of the caulk 56 from the building components 22*a*, 22*b* thereby avoiding deterioration of the joint 50.

Specifically, as the adjacent components 22*a*, 22*b* contract or move away from each other as shown by arrows C, the crown or convex-shaped surface 66 promotes narrowing or necking down of the thinnest portion 68 of the caulk material 56 adjacent an apex 70 of the crown-shaped edge 66 as shown. This crowing or necking of the caulk material 56 along the apex 70 advantageously avoids separation of the caulk 56 from the adjacent building components 22*a*, 22*b* which occurs with many prior art arrangements. In that the hour glass-shaped configuration of the caulk 56 provides for stretching of the caulk in the narrow middle portion 68 of the bead 56, when the components 22*a*, 22*b* adjacent the caulk 56, the narrow middle portion of the caulk 68 adjacent the apex 70 of the crown edge 66 further necks down avoiding separation of the caulk 56 at the interface with the adjacent building components 22*a*, 22*b*. Moreover, the second leg 44 having one or more frangible connections 62 each which provide a crown or convex-shaped edge 66 allows for easy, convenient and reliable installation of the joint device during construction. The appropriate number of end portions 60 are removed from the body portion 58 to provide the recess 54 of the proper depth for application of the caulk 56.

In one embodiment, the second leg 48 of the control device 44 is closed-cell, neoprene-EPDM foam attached to an L-bracket forming the first leg 46. The control device 44 may be used around windows and doors, as well as in movement joint applications, to create and fill a uniform space between materials. Moreover, the segmented configuration of the second leg 48 allows an installer to remove the desired number of terminal end portions depending upon the size of the space between the walls 12, 14 so that the space is not occluded with an incompressible material such as mortar for a properly finished and easily installed movement joint.

Figure 3:
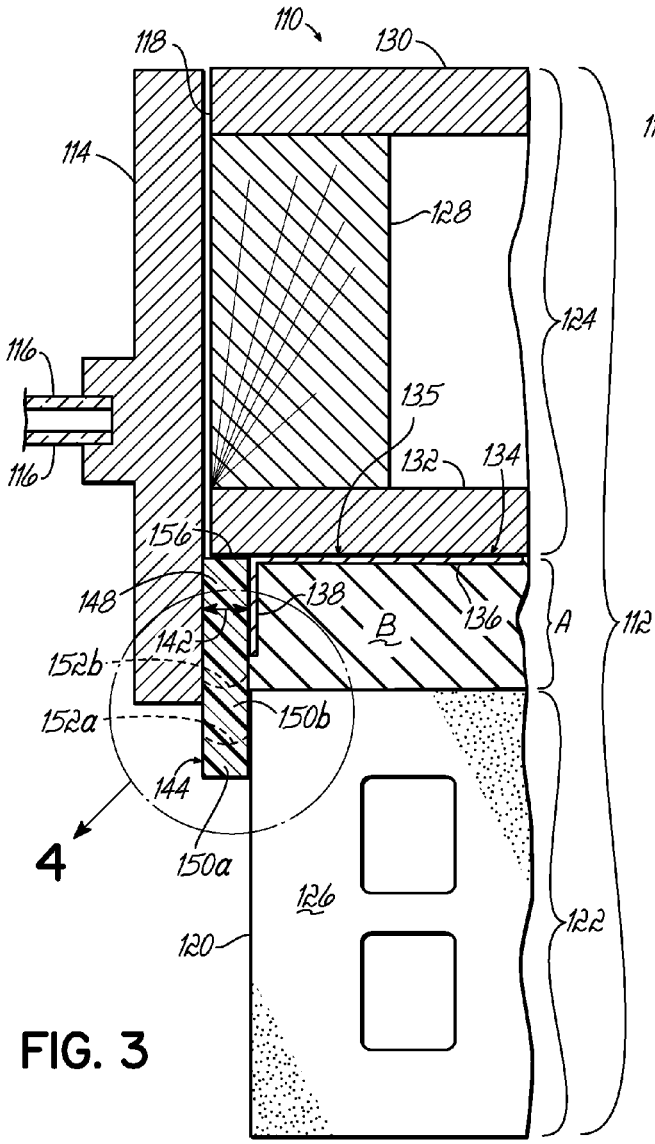
FIG. 3 is a view of an exemplary window installation in which a further embodiment of a movement joint device according to this invention can be utilized.

Referring to FIG. 3, another embodiment of this invention is shown used in an exemplary window installation 110 in a masonry wall 112. The window installation 110 includes a perimeter window frame 114, one or more window panes 116, and a window opening 118 in the wall defined by a pair of jambs 120 and a header (not shown) above and a sill (not shown) below the window frame 114. Although one example of a window installation is shown in FIG. 3, this invention is readily applicable for a variety of window installations, frame designs, doors and other openings or interruptions in the masonry wall. Moreover, this invention is not limited to window or door installations and is readily applicable for transitions, joints or junctures between any adjacent building or construction components.

As the environment for one application of this invention, the masonry wall 112 for the exterior of a building includes an outer wall 122 of masonry or brick veneer and an insulated interior wall 124. The brick veneer outer wall 122 is constructed from bricks or blocks 126 arranged in a vertical pattern. The brick veneer 122 is built up by placing one layer of bricks 126 over another layer. The spaces between adjacent bricks 126 and between adjacent layers of bricks are filled with mortar. Alternatively, the veneer 126 may be stone or other masonry components.

The interior wall 124 includes wood framing studs 128, dry wall 130, and outer sheathing material 132. Other materials may be used as is well known in the art. In any event, the building wall 112 is constructed so that there is a small cavity or airspace A between the back side of the outer wall 122 and the outer surface of the interior wall 124. The airspace A between the back side of the outer wall 122 and the surface of the interior wall 124 is usually at least about one to two inches deep, although the exact dimension may vary depending upon the nature of the construction.

Figure 4:
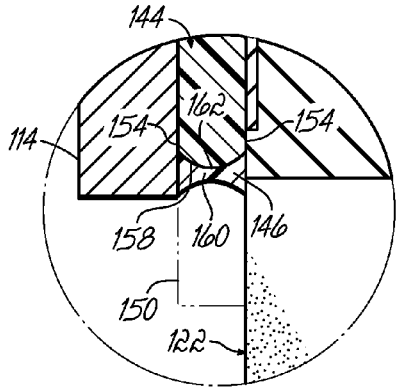
FIG. 4 is a view of the region 4 of FIG. 3 after final installation and finishing.
Figure 4A:
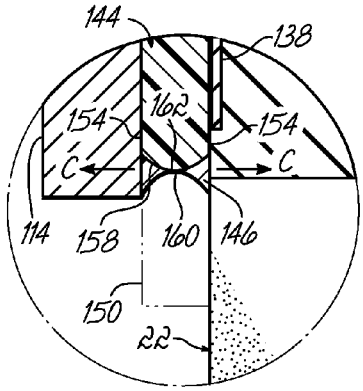
FIG. 4A is a view similar to FIG. 4 of the components of such an installation during movement.

Referring to FIGS. 3-4A, one embodiment of a joint device 134 is shown installed in the wall 112 to provide a proper transition from the window frame 114 to the wall 112. The device 134 is installed in the jambs 120 of the window frame 114. In one embodiment, the device 134 includes a generally L-shaped bracket 135, in which a first leg 136 confronts an outer face of the inner wall 124, and a second leg 138 of the device 134 projects generally perpendicular to the plane of the wall 112 and is juxtaposed to the outer wall 122 at the window opening 118 to provide a transition from the window frame 114 to the wall 112. The L-shaped bracket 135 can be utilized to nail the device 134 into place against the components 112, 114 if adhesive alone will not provide a secure mounting. As is readily apparent, particularly from FIG. 3, the forward-most edge 40 of the window frame 114 is recessed relative to the front face of the outer wall 122. When the dimensional relationship between the face of the frame and the back of the outer masonry wall are within about 0.75 inches, the placement of the traditional backer rod is compromised because there is not enough window frame and masonry surface available to hold the backer rod in place. Therefore, this invention provides a proper transition from the window frame 114 to the wall 112 that is effectively sealed against wind, rain, and other elements as well as aesthetically pleasing is often difficult. The wide variety, sizes and configurations of window frames 114 available from various manufacturers increases the complexity and difficulty with providing a proper transition from the window frame 114 to the wall 112.

A recess 142 is formed between the adjacent components 112, 114. A portion 144 of the device 134 is mounted to the leg 138 and is open or closed cell foam or similar material is inserted in the recess 142 and a bead of caulk 146 is applied between the frame 114 and the adjacent portion of wall 112 to provide a proper finished transition, and thereby substantially cover and seal the recess 142. The leg 138 conveniently positions the portion 144 against the components 112, 114 and the leg 136 is held by mortar fill at the back of the outer masonry wall 112.

The joint device 134 of this embodiment of this invention also allows for expansion and contraction of one component, such as the window frame 114 relative to another component, such as the wall 112 during a variety of climatic conditions. The portion 144 and caulk 146 accommodate expansion and contraction of the adjacent components 112, 114 relative to each other.

Referring to FIGS. 3, 4 and 4A, the portion 144 according to one embodiment of this invention includes a main body portion 148 and one or more distal, terminal end portions 150*a*, 150*b* serially connected to the body portion 148 by frangible joints or connections 152*a*, 152*b*. Each frangible joint or connection 152*a*, 152*b* may be linear or shaped arcuately and non-linearly relative to the planar, spaced, side edges 154 of the portion 144. A planar end surface 156 is spaced from the terminal portions 150.

As a result of the connections 152*a*, 152*b* between the body portion 148 and the adjacent end portions 150*a*, 150*b* of the portion 144 of the joint device 134, when the device 134 is inserted into the recess 142 between adjacent building components, such as the window frame 114 and adjacent wall 112, one or more of the terminal end portions 150*a*, 150*b* is severed or removed from the body portion 148 along the appropriate frangible connection 152*a*, 152*b*. The frangible connection 152*a* joining the distal-most terminal end portion 150*a* is referred to as the primary frangible connection and all other frangible connections associated with other end portions are referred to as secondary frangible connections. As a result, the device 134 remaining in the recess 142 includes a crown or convex-shaped surface or linear edge 158 depending upon the geometry of the device 134. The device 134 may include any number of serially connected terminal end portions 150 and the appropriate frangible connections 152 as shown in FIG. 1. The appropriate number of the terminal end portions 150 are removed to present the recessed convex or crown-shaped surface 158 as shown in FIG. 4 or a linear surface generally perpendicular to the side edges 154 of the device 134.

After the terminal end portion(s) 150 is/are removed from the body portion 148 of the device 134, the appropriate bead of caulk 146 is applied to the surface 158 to provide a finished transition between the adjacent building or construction components 112, 114. The surface 158 of the device 134 accommodates expansion, contraction and/or general movement of the adjacent building components as shown by arrows C in FIG. 4A without separation of the caulk 146 from the building components 112, 114 thereby avoiding deterioration of the joint.

Specifically, in one embodiment as the adjacent components 112, 114 contract or move away from each other as shown by arrows C, the crown or convex-shaped surface 158 of the device 134 promotes narrowing or necking down of the thinnest portion 160 of the caulk material 146 adjacent an apex 162 of the crown-shaped edge 158 as shown by comparing FIGS. 4 and 4A. This crowing or necking of the caulk material 146 along the apex 162 of the convex edge 158 advantageously avoids separation of the caulk 146 from the adjacent building components 112, 114, which occurs with the prior art wherein the prior art device has a generally linear or planar edge. In that the hour glass-shaped configuration of the caulk 146 in FIG. 4 provides for stretching of the caulk in the narrow middle portion 160 of the bead 146, when the components 112, 114 adjacent the caulk 146 move as shown in FIG. 4A, the narrow middle portion of the caulk 160 adjacent the apex 162 of the crown edge 158 further necks down avoiding separation of the caulk 146 at the interface with the adjacent building components 112, 114. Moreover, the device 134 having one or more frangible connections 152 each which provide a crown or convex-shaped edge 158 allows for easy, convenient and reliable installation during construction. The appropriate number of end portions 150 are removed from the body portion 148 to provide the recess 142 of the proper depth for application of the caulk 146.

The device 134 may be used generally at the joint between two building/construction components 112, 114. The two components may, for example, be produced from marble and provide the exterior skin of a office building. Components are spaced apart to provide a control joint for contraction and expansion of the materials. Thus, a joint is provided between both components and opens outwardly through the front exterior surfaces of components. The joint device 134 may be installed after construction or placement of one component 112 and prior to construction or placement of the other component 114. The device 134 may be polyethylene and positioned in the recess 142 and has a most forward located surface 158 located a distance from the forward surfaces of components 112, 114 to define the recess 142. Typically, the depth of the recess 142 should be one-half the width of the spacing between components 112, 114.

If the device 134 is installed prior to construction of the masonry wall 122, the installation can be easily inspected prior to masonry construction to see if the device is properly 134 installed. This assures that the mason leaves a proper gap without mortar protruding around the frame 114. Absent the device 134, it is often difficult to be assured that proper spacing is utilized for the components 112, 114.

Another benefit of the devices 44, 134 according to various embodiments of this invention is that upon proper installation, a barrier against the flow or migration of excess mortar in the masonry construction is provided. This avoids the problems of irregular and occluded spaces.

From the above disclosure of the general principles of the present invention and the preceding detailed description of at least one preferred embodiment, those skilled in the art will readily comprehend the various modifications to which this invention is susceptible. Therefore, we desire to be limited only by the scope of the following claims and equivalents thereof.

We claim:

1. A movement joint comprising:

a first inner wall;

a second outer wall spaced from the first inner wall to define a gap there between;

a pair of adjacent components;

wherein the second outer wall is a masonry veneer and the pair of adjacent components are a pair of adjacent bricks with the movement joint there between;

a joint device positioned between the adjacent components;

a bead of caulk applied to the joint device and contacting the adjacent components to form a joint there between;

wherein the joint device further comprises:

(a) a main body portion with a longitudinal axis;

(b) a terminal portion;

(c) a leg extending generally perpendicular to the main body portion; and (d) a primary frangible connection joining the main body portion and the terminal portion together, the primary frangible connection being adapted to be severed to remove the terminal portion from the main body portion and the main body portion being adapted to receive the caulk thereon to form the joint between the adjacent components;

wherein the leg is mounted to a face of the first inner wall confronting the second outer wall and the main body portion spans the gap and is positioned between the pair of adjacent components which are in the second outer wall.

2. The movement joint of claim 1 wherein the primary frangible connection is generally parallel to the longitudinal axis of the main body portion.

3. The movement joint of claim 1 wherein a cross-sectional configuration of the primary frangible connection is non-linear.

4. The movement joint of claim 3 wherein the cross-sectional configuration is generally arcuate.

5. The movement joint of claim 4 wherein a surface of the main body portion adjacent to the frangible connection and which is exposed once the terminal portion is severed from the main body portion via the primary frangible connection is convex shaped.

6. The movement joint of claim 3 wherein the cross-sectional configuration of the frangible connection is symmetric.

7. The movement joint of claim 1 wherein the main body portion includes at least one generally planar surface.

8. The movement joint of claim 7 further comprising:

a plurality of the generally planar surfaces on the main body portion, two of the generally planar surfaces are generally parallel and spaced from one another and adjacent to the frangible connection and another of which is spaced from the frangible connection and generally perpendicular to the other two planar surfaces.

9. The movement joint of claim 1 further comprising a plurality of the terminal portions and at least one secondary frangible connection each of which joins one of the terminal portions to an adjacent terminal portion.

10. The movement joint of claim 9 wherein each of the terminal portions is serially connected to the adjacent terminal portion via one of the secondary frangible connections.

11. The movement joint of claim 9, wherein each of the terminal portions is serially connected to the adjacent terminal portion along the longitudinal axis.

12. The movement joint of claim 1 wherein the terminal portion is joined to a distal end of the main body portion along the longitudinal axis.

13. The movement joint of claim 1 wherein the main body and terminal portions are integrally formed of one of open cell foam material or closed cell foam material.

* * * * *